US011233321B2

(12) United States Patent
Park et al.

(10) Patent No.: US 11,233,321 B2
(45) Date of Patent: Jan. 25, 2022

(54) ANTENNA STRUCTURE AND DISPLAY DEVICE INCLUDING THE SAME

(71) Applicant: DONGWOO FINE-CHEM CO., LTD., Jeollabuk-do (KR)

(72) Inventors: Dong Pil Park, Incheon (KR); Yun Seok Oh, Gyeonggi-do (KR); Yoon Ho Huh, Seoul (KR)

(73) Assignee: DONGWOO FINE-CHEM CO., LTD., Jeollabuk-do (KR)

( * ) Notice: Subject to any disclaimer, the term of this patent is extended or adjusted under 35 U.S.C. 154(b) by 24 days.

(21) Appl. No.: 16/629,654

(22) PCT Filed: Dec. 5, 2019

(86) PCT No.: PCT/KR2019/017096

§ 371 (c)(1),
(2) Date: Jan. 9, 2020

(87) PCT Pub. No.: WO2020/116959

PCT Pub. Date: Jun. 11, 2020

(65) Prior Publication Data

US 2021/0066790 A1 Mar. 4, 2021

(30) Foreign Application Priority Data

Dec. 6, 2018 (KR) ..... 10-2018-0155827

(51) Int. Cl.

| | |
|---|---|
| ***H01Q 1/38*** | (2006.01) |
| ***H01Q 1/24*** | (2006.01) |
| ***H01Q 1/44*** | (2006.01) |
| ***H01Q 1/50*** | (2006.01) |

(52) U.S. Cl.
CPC ..... *H01Q 1/38* (2013.01); *H01Q 1/243* (2013.01); *H01Q 1/44* (2013.01); *H01Q 1/50* (2013.01)

(58) Field of Classification Search
CPC ..... H01Q 1/38; H01Q 1/243; H01Q 1/44; H01Q 1/50; H01Q 1/36; H01Q 1/22
See application file for complete search history.

(56) References Cited

U.S. PATENT DOCUMENTS

| | | | | |
|---|---|---|---|---|
| 9,564,938 | B1 * | 2/2017 | Wang | H01Q 1/40 |
| 9,882,284 | B2 * | 1/2018 | Eom | H01Q 13/10 |
| 10,038,245 | B2 * | 7/2018 | Choi | H01Q 5/364 |
| 10,404,695 | B2 * | 9/2019 | Jang | H04L 63/0492 |
| 2012/0162032 | A1 | 6/2012 | Yang et al. | |
| 2013/0106661 | A1 * | 5/2013 | Xiang | H01Q 1/40 343/702 |

(Continued)

FOREIGN PATENT DOCUMENTS

| | | | |
|---|---|---|---|
| CN | 1964134 | A | 5/2007 |
| CN | 101180765 | A | 5/2008 |
| CN | 103703610 | A | 4/2014 |

(Continued)

*Primary Examiner* — Seung H Lee
(74) *Attorney, Agent, or Firm* — The PL Law Group, PLLC

(57) ABSTRACT

In an antenna structure according to exemplary embodiments of the present invention, a metal layer provided as a rear metal case of the display panel, a protecting layer and an antenna electrode layer are laminated in this order. The rear metal case may be used as a ground layer so that an additional space for the antenna is secured, and signal efficiency and reliability may be improved.

15 Claims, 4 Drawing Sheets

(56) References Cited

U.S. PATENT DOCUMENTS

| | | | |
|---|---|---|---|
| 2014/0106684 | A1 | 4/2014 | Burns et al. |
| 2014/0292588 | A1 | 10/2014 | Yoon et al. |

FOREIGN PATENT DOCUMENTS

| | | | |
|---|---|---|---|
| CN | 103811856 | A | 5/2014 |
| CN | 105870575 | A | 8/2016 |
| CN | 106101303 | A | 11/2016 |
| EP | 1286413 | A1 | 2/2003 |
| KR | 10-2007-0062189 | A | 6/2007 |
| KR | 10-2013-0095451 | A | 8/2013 |
| KR | 10-2014-0120420 | A | 10/2014 |
| KR | 10-1572022 | B1 | 11/2015 |
| KR | 10-2016-0137315 | A | 11/2016 |
| WO | 2020/116959 | A1 | 6/2020 |

* cited by examiner

ANTENNA STRUCTURE AND DISPLAY DEVICE INCLUDING THE SAME

CROSS REFERENCE TO RELATED APPLICATIONS AND CLAIM OF PRIORITY

This application claims benefit under 35 U.S.C. 119(e), 120, 121, or 365(*c*), and is a National Stage entry from International Application No. PCT/KR2019/017096, filed Dec. 5, 2019, which claims priority to the benefit of Korean Patent Application No. 10-2018-0155827 filed in the Korean Intellectual Property Office on Dec. 6, 2018, the entire contents of which are incorporated herein by reference.

TECHNICAL FIELD

The present invention relates to an antenna structure and a display device including the same. More particularly, the present invention relates to an antenna structure including an antenna electrode layer, and a display device including the antenna structure.

DESCRIPTION OF THE RELATED ART

Recently, according to development of the information-oriented society, wireless communication techniques such as Wi-Fi, Bluetooth, and the like are implemented, for example, in a form of smartphones by combining with display devices. In this case, an antenna may be coupled to the display device to perform a communication function.

Recently, with mobile communication techniques becoming more advanced, it is necessary for an antenna for performing communication in ultra-high frequency bands to be coupled to the display device.

For example, in the case of recent 5G mobile communication in high frequency bands, as the wavelength is shorter, a case in which signal transmission and reception may be blocked occurs, and the frequency band that is available for transmission and reception is narrow, thereby being vulnerable to signal loss and signal blocking. Accordingly, requirements for high frequency antennas having desired directivity, gain and signal efficiency are increased.

In addition, as the display device on which the antenna is mounted becomes thinner and lighter, a space occupied by the antenna may also be reduced. Accordingly, there is a limit to simultaneously implementing the transmission and reception of high frequency and wideband signals within a limited space.

For example, Korean Publication of Patent Application No. 2013-0095451 discloses an antenna integrally formed with a display panel, however, it did not provide an alternative idea to solve the above-described problems.

SUMMARY

According to an aspect of the present invention, there is provided an antenna structure having improved space utilization and signal quality.

According to an aspect of the present invention, there is provided a display device having improved space utilization and signal quality.

1. An antenna structure including: a metal layer provided as a rear metal case of a display panel; a protecting layer disposed on a bottom surface of the metal layer; and an antenna electrode layer disposed on a bottom surface of the protecting layer.

2. The antenna structure according to the above 1, wherein the metal layer is provided as a ground layer for the antenna electrode layer.

3. The antenna structure according to the above 1, wherein the protecting layer is provided as a dielectric layer.

4. The antenna structure according to the above 1, further including a transparent resin film disposed between the protecting layer and the antenna electrode layer.

5. The antenna structure according to the above 4, further including a transparent adhesive layer disposed between the protecting layer and the transparent resin film.

6. The antenna structure according to the above 1, wherein the antenna electrode layer includes: a radiating pattern; a signal pad electrically connected with the radiating pattern; and ground pads disposed to face each other with the signal pad interposed therebetween.

7. The antenna structure according to the above 6, wherein the radiating pattern and the signal pad includes at least one selected from the group consisting of silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn) and alloys thereof.

8. The antenna structure according to the above 6, wherein the ground pad is electrically connected with the metal layer.

9. The antenna structure according to the above 8, further including a ground contact penetrating the protecting layer to electrically connect the ground pad and the metal layer.

10. The antenna structure according to the above 8, further including a ground wiring extending along a side face of the protecting layer to electrically connect the ground pad and the metal layer.

11. The antenna structure according to the above 6, wherein the radiating pattern, the signal pad and the ground pad include a mesh structure.

12. The antenna structure according to the above 11, wherein the mesh structure has a line width of 2 μm to 10 μm, and a thickness of 10 nm to 500 nm.

13. The antenna structure according to the above 11, further including a dummy mesh layer disposed around the antenna electrode layer.

14. The antenna structure according to the above 1, further including an antenna protecting layer disposed on the antenna electrode layer.

15. A display device including: a display panel; a metal layer provided as a rear metal case of the display panel; a protecting layer disposed on a bottom surface of the metal layer; and an antenna electrode layer disposed on a bottom surface of the protecting layer.

16. The display device according to the above 15, further including a window cover disposed on a visible surface of the display panel, wherein the metal layer is disposed on a surface opposite to the visible surface of the display panel.

According to example embodiments as described above, the protecting layer and the antenna electrode layer may be laminated on the metal layer provided as the rear metal case of the display panel. In addition, the rear metal case of the display device may be used as the ground layer of the antenna, and the protecting layer may be used as the dielectric layer.

By disposing the antenna on the surface opposite to the visible side of the display device, an additional space for the antenna may be secured. Therefore, multiple antennas operated at different frequency bands may be installed on the rear metal case. Additionally, an electromagnetic interference with the touch sensor disposed on the visible side of the display device may be avoided.

DETAILED DESCRIPTION

Figure 1:
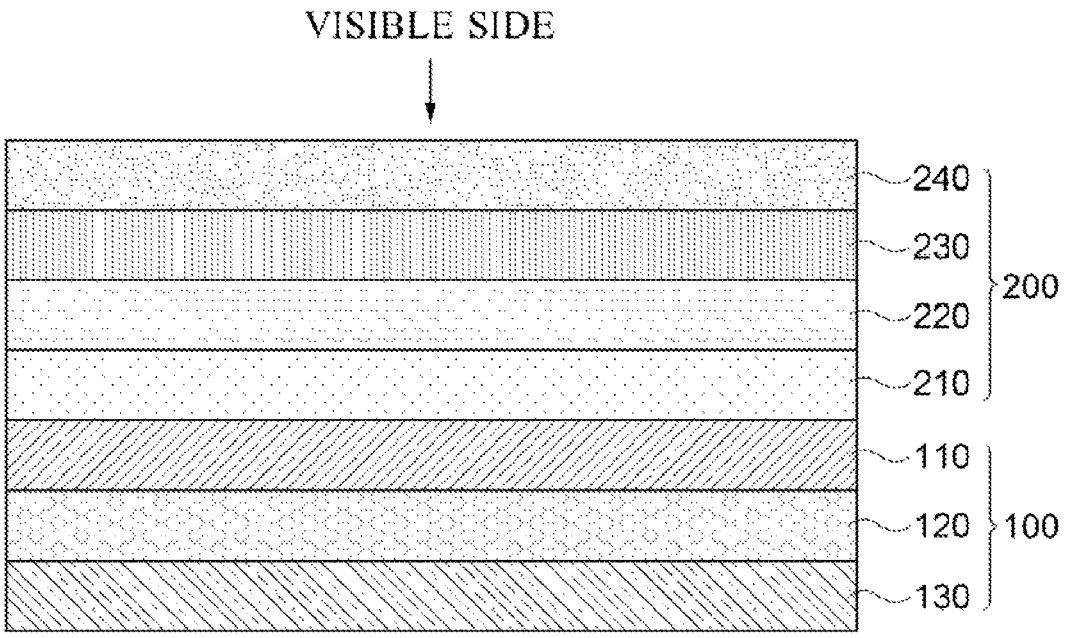
FIG. 1 is a schematic cross-sectional view illustrating a display device including an antenna structure in accordance with exemplary embodiments.

According to exemplary embodiments of the present invention, an antenna structure in which a metal layer provided as a rear metal case of a display panel, a protecting layer and an antenna electrode layer are disposed in this order, and a display device including the antenna structure are provided. The rear metal case may be used as a ground layer so that an additional space for the antenna is secured, and signal efficiency and reliability may be improved.

The antenna structure may be, for example, a microstrip patch antenna manufactured in a form of a transparent film. The antenna structure may be applied to, for example, communication devices for 3G to 5G mobile communications.

Hereinafter, exemplary embodiments of the present invention will be described in detail with reference to the accompanying drawings. However, since the drawings attached to the present disclosure are only given for illustrating one of preferable various embodiments of present invention to easily understand the technical spirit of the present invention with the above-described invention, it should not be construed as limited to such a description illustrated in the drawings.

FIG. 1 is a schematic cross-sectional view illustrating a display device including an antenna structure according to exemplary embodiments.

Referring to FIG. 1, the display device including the antenna structure according to exemplary embodiments may include an antenna structure 100 and a display module 200.

The antenna structure 100 may include a metal layer 110, a protecting layer 120, and an antenna electrode layer 130. The metal layer 110 may be provided as a lower metal case (also referred to as a rear metal case) of the display module 200, and the display module 200 may include a display panel 210, a touch sensor layer 220, a polarizing plate 230, and a window cover 240.

The metal layer 110 may be provided as the lower metal case of the display panel 210. The lower metal case may be disposed on a surface opposite to a visible side (also referred to as a visible surface) of the display module 200. The lower metal case may be provided as a housing for internal components (e.g., the display panel 210, the touch sensor layer 220, and the like) of the display module 200. The lower metal case may protect the display module 200 from an external impact (e.g., an impact applied to the display module 200 from a bottom thereof).

In some embodiments, the metal layer 110 may include a metal plate. The metal plate may be made of at least one selected from the group consisting of aluminum (Al), copper (Cu), silver (Ag), gold (Au), platinum (Pt), palladium (Pd), chromium (Cr), titanium (Ti), vanadium (V), cobalt (Co), nickel (Ni) and alloys thereof. These metals may be used alone or in combination of two or more thereof.

In some embodiments, the metal layer 110 may have conductivity. Therefore, the metal layer 110 may be provided as a ground layer for a patch type antenna. For example, the metal layer 110 may be provided as the lower metal case of the display module 200, as well as may be provided as the ground layer of the antenna structure.

The display module 200 may include a liquid crystal display, an organic light emitting diode display, a plasma display and the like. The display module 200 may include a display panel 210, a touch sensor layer 220, a polarizing plate 230 and a window cover 240.

The display panel 210 may include liquid crystals, organic light emitting diodes, and a plasma display panel. The metal layer 110 may be disposed on the surface opposite to the visible side of the display panel 210.

The touch sensor layer 220 may be disposed on an upper surface of the display panel 210. The touch sensor layer 220 may include a pressure sensitive or capacitive touch sensor. The touch sensor layer 220 may be light transmissive. For example, the touch sensor layer may include a transparent touch electrode and an electrode wiring.

The polarizing plate 230 may be disposed on an upper surface of the touch sensor layer 220 as illustrated in FIG. 1, but the position to be disposed is not limited as long as it is the upper surface of the touch sensor layer 220.

The window cover 240 may be disposed on the outermost upper surface of the display module 200. The window cover 240 may protect the internal components of the display module 200 from an external physical impact, moisture, and a change in the temperature.

For example, window cover 240 may be made of glass or reinforced plastic.

In some embodiments, the window cover 240 may include an antireflective layer, an antiglare layer, an antistatic layer, a hard coating layer, an antifouling layer, and the like, which are formed on an upper surface thereof.

The protecting layer 120 may be disposed on a bottom surface of the metal layer 110. For example, the protecting layer may be disposed in direct contact with the bottom surface of the metal layer 110. The protecting layer 120 may protect the metal layer 110 from the external impact. Therefore, it is possible to prevent the beauty of the metal layer 110 from being deteriorated due to breakage, stabbing, scratching or the like.

The protecting layer 120 may include a transparent resin material. For example, the protecting layer 120 may include a polyester resin such as polyethylene terephthalate, polyethylene isophthalate, polyethylene naphthalate, polybutylene terephthalate, etc.; a cellulose resin such as diacetyl cellulose, triacetyl cellulose, etc.; a polycarbonate resin; an acryl resin such as polymethyl (meth)acrylate, polyethyl (meth)acrylate, etc.; a styrene resin such as polystyrene, acrylonitrile-styrene copolymer, etc.; a polyolefin resin such as polyethylene, polypropylene, cyclic polyolefin or polyolefin having a norbornene structure, ethylene-propylene copolymer, etc.; a vinyl chloride resin; a polyimide resin such as nylon, aromatic polyimide; an imide resin; a polyether sulfonic resin; a sulfonic resin; a polyether ketone resin; a polyphenylene sulfide resin; a vinylalcohol resin; a vinylidene chloride resin; a vinylbutyral resin; an allylate resin; a polyoxymethylene resin; an epoxy resin and the like. These compounds may be used alone or in combination of two or more thereof.

In addition, a transparent film made of a thermosetting resin or an ultraviolet curable resin such as (meth)acrylate, urethane, acrylic urethane, epoxy, silicone, and the like may be used as the protecting layer 120. In some embodiments, an adhesive film such as an optically clear adhesive (OCA), an optically clear resin (OCR), and the like may also be included in the protecting layer 120.

In some embodiments, the protecting layer 120 may include an inorganic insulation material such as silicon oxide, silicon nitride, silicon oxynitride, glass and the like.

In some embodiment, the protecting layer 120 may be provided in a substantially single layer. In some embodiment, the protecting layer 120 may also include a multilayer structure of two or more layers.

Capacitance or inductance may be generated between the antenna electrode layer 130 and the metal layer 110 by the protecting layer 120, thus to adjust a frequency band which can be driven or sensed by the antenna structure. In some embodiments, a dielectric constant of the protecting layer 120 may be adjusted to a range of about 1.5 to 12. When the dielectric constant exceeds about 12, a driving frequency is excessively reduced, such that driving of the antenna in a desired high frequency band may not be implemented.

In some embodiments, the protecting layer 120 may entirely overlap with the antenna electrode layer 130 in a planar direction.

The antenna electrode layer 130 may be disposed on a bottom surface of the protecting layer 120. For example, the antenna electrode layer 130 may be disposed in direct contact with the bottom surface of the protecting layer 120.

Figure 2:
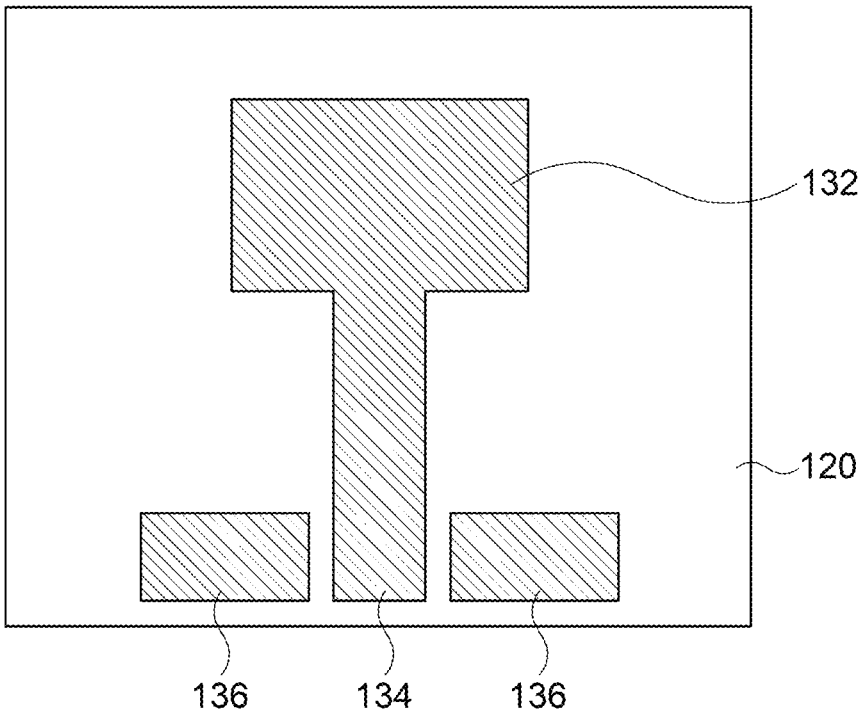
FIG. 2 is a schematic view illustrating an antenna electrode layer in accordance with exemplary embodiments.

FIG. 2 is a schematic view illustrating the antenna electrode layer according to exemplary embodiments.

Referring to FIG. 2, the antenna electrode layer 130 may include a radiating pattern 132, a signal pad 134, and ground pads 136. The antenna electrode layer 130 may be disposed on the bottom surface of the protecting layer 120. For example, the antenna electrode layer 130 may be directly formed on the bottom surface of the protecting layer 120.

According to some exemplary embodiments, the antenna electrode layer 130 may further include a transmission line and a pad electrode. The transmission line may be branched from the radiating pattern 132. The pad electrode may include the signal pad 134 and the ground pads 136. The radiating pattern 132 and the signal pad 134 may be electrically connected with each other by the transmission line.

In some embodiments, an end portion of the transmission line may be provided as the signal pad 134. In some embodiments, the transmission line and the signal pad 134 may be integrally connected with the radiating pattern 132 to be provided as a single part.

The ground pads 136 may be disposed so as to face each other with the signal pad 134 interposed therebetween. For example, a pair of ground pads 136 may be formed at opposite positions with the signal pad 134 being in the center therebetween. The ground pads 136 may be spaced apart from the signal pad 134 by a predetermined distance.

In some embodiments, the radiating pattern 132, the signal pad 134 and the ground pad 136 may include silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn) or alloys thereof. These metals may be used alone or in combination of two or more thereof. For example, to implement a low resistance in the antenna, silver or a silver alloy (e.g., a silver-palladium-copper (APC) alloy) may be used. By using the above-described metal or the alloy of metals as the radiating pattern 132 and the signal pad 134, the resistance of the antenna electrode may be greatly decreased. Therefore, it is possible to improve signal efficiency and reliability of the antenna. For example, high-frequency (hertz, Hz) band signals may be greatly affected by the resistance of the antenna. Therefore, by reducing the resistance of the antenna, the high-frequency band signals may be effectively transmitted and received.

In some embodiments, the antenna electrode layer 130 may include a transparent metal oxide such as indium tin oxide (ITO), indium zinc oxide (IZO), indium zinc tin oxide (IZTO), or zinc oxide ($ZnO_x$).

The display module 200 may include a main board (not illustrated). The main board may include a touch sensor driving circuit, a display panel driving circuit, and an antenna driving IC (integrated circuit) chip.

The antenna driving IC chip may be electrically connected to the antenna electrode layer 130. For example, a driving wiring for connecting the antenna driving IC chip and the signal pad 134 of the antenna electrode layer 130 may be formed. The driving wiring may pass through the metal layer 110 and the protecting layer 120 to connect the main board and the antenna electrode layer 130. In some embodiments, the driving wiring may extend to side faces of the metal layer 110 and the protecting layer 120 through a space between outer cases (e.g., the window cover 240 and the lower metal case) and the internal components of the display module 200 to connect the main board and the antenna electrode layer 130.

Figure 3:
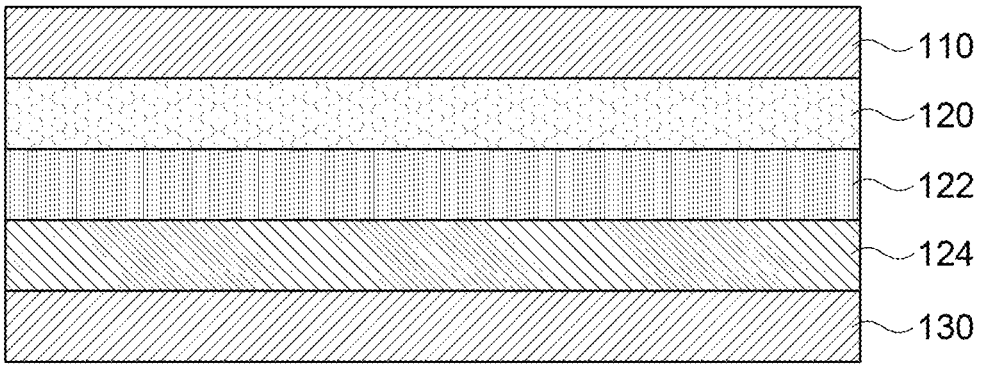
FIG. 3 to FIG. 5 are schematic cross-sectional views illustrating antenna structures in accordance with some exemplary embodiments.
Figure 4:
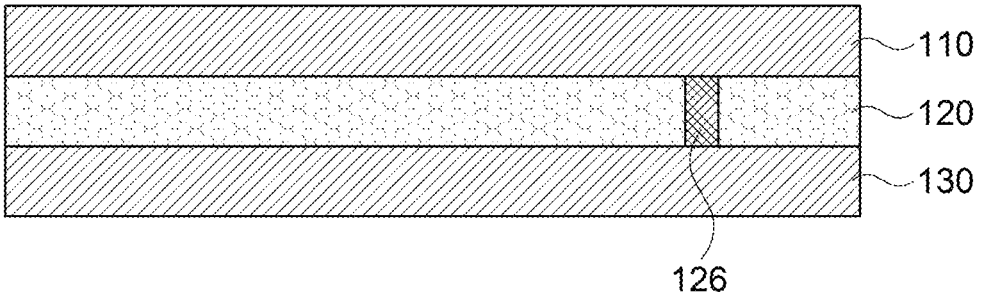
Figure 5:
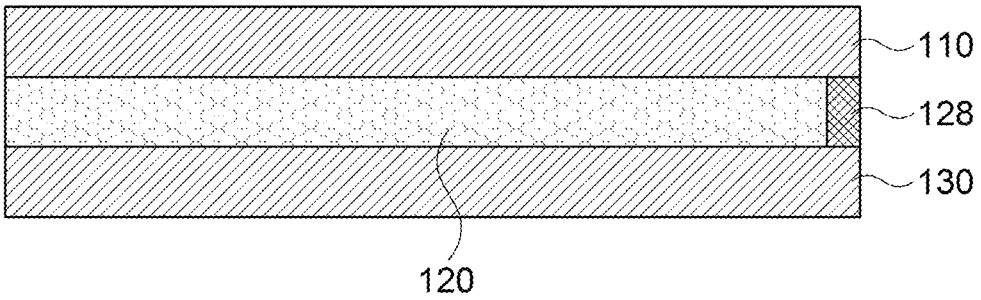

FIGS. 3 to 5 are schematic cross-sectional views illustrating antenna structures according to some exemplary embodiments.

Referring to FIG. 3, the antenna structure according to exemplary embodiments may include a transparent adhesive layer 122 and a transparent resin film 124.

In exemplary embodiments, the transparent resin film 124 may be disposed between a protecting layer 120 and an antenna electrode layer 130.

In exemplary embodiments, the radiating pattern 132, the signal pad 134, and the ground pad 136 may be formed on the transparent resin film 124. In some embodiments, the radiating pattern 132, the signal pad 134, and the ground pad 136 may be formed inside the transparent resin film 124. An antenna structure 100 may be manufactured by adhering the transparent resin film 124 having the antenna electrode layer 130 formed thereon to the bottom surface of the protecting layer 120.

For example, the transparent resin film 124 may include a cyclic olefin polymer (COP), polyethylene terephthalate (PET), polyimide (PI), liquid crystal polymer (LCP), polymethyl methacrylate (PMMA) and the like.

In some embodiments, the transparent adhesive layer 122 may be disposed between the protecting layer 120 and the transparent resin film 124. The transparent resin film 124 and the protecting layer 120 may be adhered by the transparent adhesive layer 122.

For example, the transparent adhesive layer 122 may be formed on the upper surface of the transparent resin film 124. The transparent adhesive layer 122 may be adhered to the protecting layer 120 to manufacture the antenna structure 100. The transparent adhesive layer 122 may include a film made of an optically clear adhesive (OCA) or optically clear resin (OCR).

In exemplary embodiments, the ground pad 136 may float with respect to the metal layer 110 to be disposed. For example, the ground pad 136 and the metal layer 110 may be disposed vertically while separated by the protecting layer 120. Therefore, the ground pad 136 and the metal layer 110 may be electrically disconnected by the protecting layer 120.

In some embodiments, the ground pad 136 may be electrically connected with the metal layer 110.

Referring to FIG. 4, the antenna structure 100 may include a ground contact 126.

In some embodiments, the ground contact 126 or ground via may be formed in the protecting layer 120 with vertically penetrating the same. The ground contact 126 may contact with the metal layer 110 and the ground pad 136 while penetrating the protecting layer 120 in a thickness direction. Therefore, the metal layer 110 and the ground pad 136 may be electrically connected by the ground contact.

For example, the ground contact 126 may have a diameter of 30 mm or more, and a distance between adjacent ground contacts 126 may be 2 times or more the diameter of the ground contact. A plurality of ground contacts 126 that satisfy the above-described standard and arrangement may greatly improve conduction efficiency of the metal layer 110 and the ground pad 136. The ground contact 126 may have a diameter of 200 μm or less, and a distance between adjacent ground contacts 126 may be 4 times or less the diameter of the ground contact. More preferably, the ground contact 126 may have a diameter of 50 to 100 μm, and the distance between adjacent ground contacts 126 may be 2 to 3 times the diameter of the ground contact.

For example, the ground contact 126 may include a conductive mediating structure. The conductive mediating structure may be made of, for example, an anisotropic conductive film (ACF). In this case, the conductive mediating structure may include conductive particles (e.g., silver particles, copper particles, carbon particles, or the lie) dispersed in the resin layer.

Referring to FIG. 5, the antenna structure 100 according to exemplary embodiments may include a ground wiring 128. The ground wiring 128 may be formed on the side face of the protecting layer 120 and may contact with the metal layer 110 and the ground pad 136. The ground wiring 128 may electrically connect the metal layer 110 and the ground pad 136.

According to exemplary embodiments, the ground wiring 128 may be formed by extending the metal layer 110. For example, the ground wiring 128 may branch from one end of the metal layer 110. The branched ground wiring 128 may extend along the side face of the protecting layer 120 to the antenna electrode layer 130 to be provided as the ground pad 136. For example, the metal layer 110, the ground wiring 128, and the ground pad 136 may be integrally formed with each other.

Figure 6:
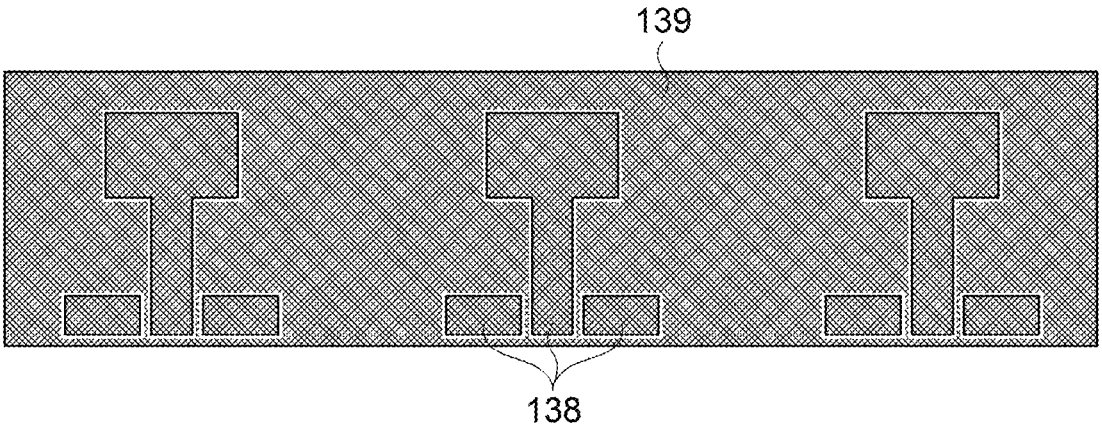
FIG. 6 is a schematic view illustrating an antenna electrode layer in accordance with exemplary embodiments.

FIG. 6 is a schematic view illustrating an antenna electrode layer according to exemplary embodiments.

Referring to FIG. 6, the antenna electrode layer 130 may include a mesh structure 138. As illustrated in FIG. 6, the radiating pattern 132, the transmission line, the signal pad 134, and the ground pad 136 may include the mesh structure 138.

For example, the radiating pattern 132, the transmission line, the signal pad 134 and the ground pad 136 may be formed in the mesh structure 138.

In exemplary embodiments, the mesh structure 138 may have a line width of 2 μm to 10 μm, and a thickness of 10 nm to 500 nm. In the above range of the line width and thickness, the mesh structure 138 may be maintained at a low level in terms of the resistance while ensuring permeability.

In some embodiments, the signal pad 134 and the ground pad 136 may be formed in a solid pattern to prevent signal loss due to an increase in the resistance.

As the antenna electrode layer 130 includes the mesh structure, transmittance of the antenna structure may be improved. Therefore, the design pattern formed on a rear surface of the display module 200 may not be hidden by the antenna electrode.

In some embodiments, a dummy mesh layer 139 may be disposed around the antenna electrode layer 130. The dummy mesh layer 139 may allow the electrode array around the antenna electrode layer 130 (e.g., around the radiating pattern 132) to be uniform, thus to prevent the mesh structure or the electrode line included therein from being viewed by a user of the display device.

For example, a mesh metal layer may be formed on the protecting layer 120, and the mesh metal layer may be cut along a predetermined region to electrically and physically separate the dummy mesh layer 139 from the radiating pattern 132, the signal pad 134 and the like.

Figure 7:
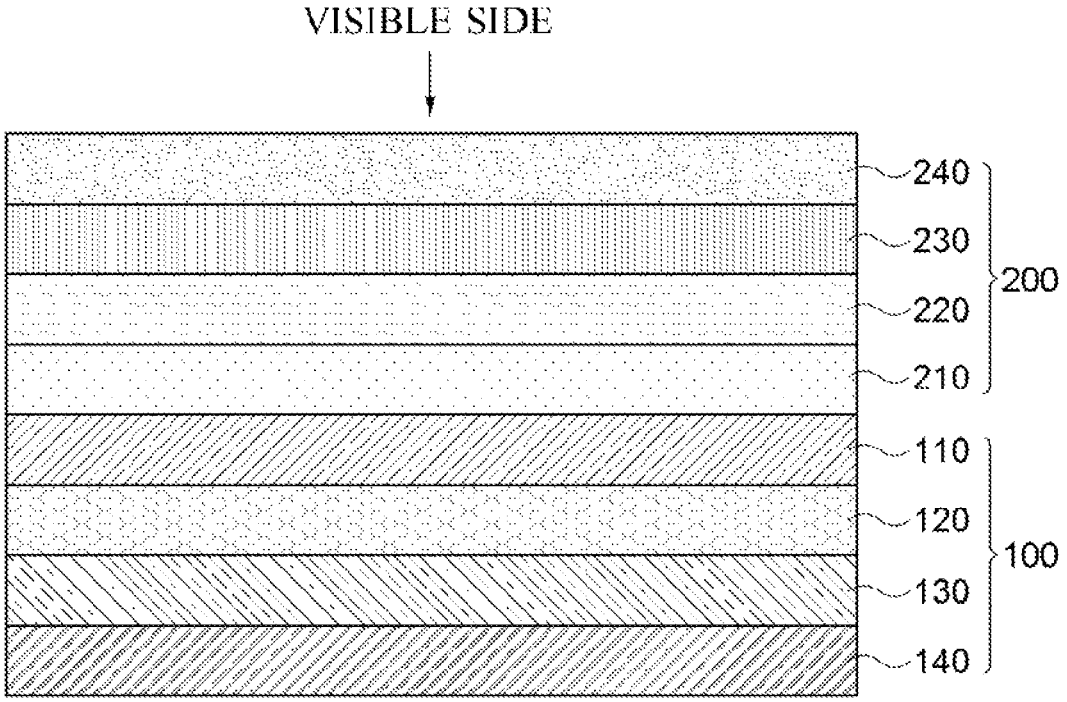
FIG. 7 is a schematic cross-sectional view illustrating a display device including an antenna structure in accordance with exemplary embodiments.

FIG. 7 is a schematic cross-sectional view illustrating a display device including an antenna structure according to exemplary embodiments.

Referring to FIG. 7, an antenna protecting layer 140 may be disposed on an antenna electrode layer 130.

According to some embodiments, the antenna protecting layer 140 may include a hard coating layer. Therefore, it is possible to protect the antenna electrode layer 130 from a physical impact.

According to exemplary embodiments, the antenna protecting layer 140 may further include functional layers such as an antistatic layer, an antifouling layer and the like. The antenna protecting layer 140 may be formed in a single layer of the hard coating layer, and may be formed in a laminate of the hard coating layer and the functional layers.

For example, the antenna protecting layer 140 may be made of a transparent resin. Therefore, the metal layer 110 disposed inside the antenna protecting layer 140 may be viewed by the user.

According to exemplary embodiments, the antenna protecting layer 140 may be formed directly on the bottom surface of the antenna electrode layer 130.

In some embodiments, the above-described antenna structure may be inserted into the rear surface of the display module 200 in a patch shape. Therefore, an electromagnetic interference with the touch sensor (e.g., the touch sensor layer 220) disposed on the front surface of the display module 200 may be avoided. For example, an electromagnetic interference between the touch sensor layer 220 and the antenna electrode layer 130 may be substantially removed by the metal layer 110 interposed between the touch sensor layer 220 and the antenna electrode layer 130. Therefore, it is possible to improve the signal quality of the antenna.

According to some embodiments, a plurality of antennas operated at various frequencies may be arranged by using the rear surface of the display module 200 having a spatial clearance. Further, a problem, in which the image quality is deteriorated when disposing the antenna on the visible side of the display panel 210 in the conventional display module 200, may be solved.

What is claimed is:

1. An antenna structure comprising:

a metal layer provided as a rear metal case of a display panel;

a protecting layer disposed on a bottom surface of the metal layer;

an antenna electrode layer disposed on a bottom surface of the protecting layer; and a transparent resin film disposed between the protecting layer and the antenna electrode layer.

2. The antenna structure according to claim 1, wherein the metal layer is provided as a ground layer for the antenna electrode layer.

3. The antenna structure according to claim 1, wherein the protecting layer is provided as a dielectric layer.

4. The antenna structure according to claim 1, further comprising a transparent adhesive layer disposed between the protecting layer and the transparent resin film.

5. The antenna structure according to claim 1, wherein the antenna electrode layer comprises:

a radiating pattern;

a signal pad electrically connected with the radiating pattern; and ground pads disposed to face each other with the signal pad interposed therebetween.

6. The antenna structure according to claim 5, wherein the radiating pattern and the signal pad include at least one selected from the group consisting of silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn) and alloys thereof.

7. The antenna structure according to claim 5, wherein the ground pad is electrically connected with the metal layer.

8. The antenna structure according to claim 7, further comprising a ground contact penetrating the protecting layer to electrically connect the ground pad and the metal layer.

9. The antenna structure according to claim 7, further comprising a ground wiring extending along a side face of the protecting layer to electrically connect the ground pad and the metal layer.

10. The antenna structure according to claim 5, wherein the radiating pattern, the signal pad and the ground pad include a mesh structure.

11. The antenna structure according to claim 10, wherein the mesh structure has a line width of 2 μm to 10 μm, and a thickness of 10 nm to 500 nm.

12. The antenna structure according to claim 10, further comprising a dummy mesh layer disposed around the antenna electrode layer.

13. The antenna structure according to claim 1, further comprising an antenna protecting layer disposed on the antenna electrode layer.

14. A display device comprising:

a display panel;

a metal layer provided as a rear metal case of the display panel;

a protecting layer disposed on a bottom surface of the metal layer;

an antenna electrode layer disposed on a bottom surface of the protecting layer; and a transparent resin film disposed between the protecting layer and the antenna electrode layer.

15. The display device according to claim 14, further comprising a window cover disposed on a visible surface of the display panel, wherein the metal layer is disposed on a surface opposite to the visible surface of the display panel.

* * * * *